US009446272B2

(12) United States Patent
Blunk et al.

(10) Patent No.: US 9,446,272 B2
(45) Date of Patent: Sep. 20, 2016

(54) SILOXANE-CONTAINING FIRE EXTINGUISHING FOAM

(75) Inventors: Dirk Blunk, Hurth (DE); Ralf Helmut Hetzer, Wietzendorf (DE); Angela Sager-Wiedmann, Munster (DE); Kai Wirz, Cologne (DE)

(73) Assignee: Universität zu Köln, Cologne (DE)

( * ) Notice: Subject to any disclaimer, the term of this patent is extended or adjusted under 35 U.S.C. 154(b) by 0 days.

(21) Appl. No.: 14/342,786

(22) PCT Filed: Sep. 3, 2012

(86) PCT No.: PCT/EP2012/067109

§ 371 (c)(1),
(2), (4) Date: Jun. 12, 2014

(87) PCT Pub. No.: WO2013/034521

PCT Pub. Date: Mar. 14, 2013

(65) Prior Publication Data

US 2014/0306141 A1 Oct. 16, 2014

(30) Foreign Application Priority Data

Sep. 6, 2011 (DE) ..... 10 2011 053 304

(51) Int. Cl.
*A62D 1/02* (2006.01)

(52) U.S. Cl.
CPC ..... *A62D 1/0071* (2013.01)

(58) Field of Classification Search
CPC ..... A62D 1/0071
USPC ..... 252/3
See application file for complete search history.

(56) References Cited

U.S. PATENT DOCUMENTS

| | | | | |
|---|---|---|---|---|
| 5,207,932 | A | 5/1993 | Norman et al. | |
| 5,891,977 | A * | 4/1999 | Dietz et al. | 528/15 |
| 2007/0134283 | A1 | 6/2007 | Wang et al. | |
| 2007/0135329 | A1 | 6/2007 | Wang et al. | |

FOREIGN PATENT DOCUMENTS

| | | | |
|---|---|---|---|
| DE | 2 357 281 | | 6/1974 |
| DE | 28 26 224 | | 1/1979 |
| DE | 693 08472 | T2 | 5/1994 |
| DE | 43 06 041 | A1 | 9/1994 |
| DE | 101 02 009 | A1 | 8/2002 |
| DE | 101 02 007 | A1 | 10/2002 |
| DE | 10 2007 016 966 | A1 | 10/2008 |
| DE | 10 2008 000 845 | A1 | 10/2009 |
| EP | 0 879 840 | A2 | 11/1998 |

OTHER PUBLICATIONS

Wagner et al. "Silicon-Modified Carbohydrate Surfactants I: Synthesis of Siloxanyl Moieties Containing Straight-Chained Glycosides and Amides" Applied Organometallic Chemistry, vol. 10, 1996, 421-435.*

* cited by examiner

*Primary Examiner* — Peter F Godenschwager
(74) *Attorney, Agent, or Firm* — Robert D. Gunderman, Jr.; Patent Technologies, LLC

(57) ABSTRACT

The invention relates to fire extinguishing foams or concentrates thereof, these comprising a carbohydrate-containing siloxane surfactant.

2 Claims, No Drawings

SILOXANE-CONTAINING FIRE EXTINGUISHING FOAM

The present invention relates to the field of fire-extinguishing foams and/or foam concentrates.

In particular, when fires comprising major quantities of burning liquids that contain organic chemicals must be extinguished, e.g. fuels, special foaming agents are usually added to the extinguishing water. These agents have surface-active properties and, contrary to conventional extinguishing foam agents, allow for independent wetting of the surface of the burning material. This is why, as a special property, such extinguishing foams, which are so-called Aqueous Film Forming Foams (AFFF), form a water film on the surface of the burning liquid. The resulting vapor barrier makes it more difficult for combustible liquids to change to their gaseous phase and thereby continue to feed the fire or result in flammable and/or explosive gaseous mixtures. Furthermore, the characteristic wetting capacities of AFFF foam allow the foam to glide on the surface of the burning liquid, thereby making it possible for the foam to reach places where the extinguishing foams cannot be directly applied. Moreover, if the surface of the foam area has been disrupted (for example, caused by falling solid items), these gaps in the foam surface close up on their own restoring the integrity of the surface area. The film, furthermore, is also active and flows in areas that the foam cannot reach directly.

Perfluorooctane sulfonate (PFOS) has been the medium of choice for quite a long time for use in such fire-extinguishing foam products. However, now that it has been established that this material is toxic, persistent and bioaccumulating, its use has been drastically curtailed by EU Directive 2006/122/EC of Dec. 12, 2006. Fire-extinguishing foams containing more than 50 ppm PFOS may no longer be used within the EU. Different surface-active agents and other polyfluorinated surface-active media are used nowadays as substitute materials for PFOS in AFFF applications. These surface-active agents are presumably not bioaccumulating and toxic, or at least they are less so. However, a final assessment regarding this issue is presently still pending and the fundamental problem of persisting polyfluorinated compounds that are released into the environment is not addressed by these substitutes.

The object of the present invention, therefore, is to provide alternate effective AFFF fire-extinguishing foam concentrates that contain, insofar as this is possible, same-acting, however preferably, fewer toxic and preferably, halogen-free surface-active agents.

This object is achieved with claim 1 of the present invention. Correspondingly, a fire-extinguishing foam concentrate is proposed that comprises as surface-active agent containing at least one substituted or unsubstituted carbohydrate or carbohydrate derivative, as well as at least one oligosiloxane. The term "containing" in this context denotes the fact that the carbohydrate or carbohydrate derivative is, like the oligosiloxane, a subcomponent of a larger molecule, and that both are covalently bonded to the rest of the molecule.

Surprisingly, it has been found that surface-active agents of this kind are suited for producing fire-extinguishing foams that are able to form a water film, and that it is possible, depending on how the foam is used, to achieve at least one of the following advantages:

Due to the high water solubility of the carbohydrates, the total site of the molecule of the surface-active agents according to the invention is adequately small while still providing sufficient solubility; small molecules are preferred in most applications, because the have higher diffusion coefficients.

The surface-active agent is free of halogen, and particularly of fluorine, and can be produced, for the most part, from renewable resources.

The surface-active agents facilitate the independent formation of a closed water film on the surface of the burning materials (for example, fuel): as a vapor barrier, this water prevents the flammable liquid from transitioning into the gaseous phase, thereby minimizing the burning material's capacity to keep feeding the fire and/or from forming combustible and/or explosive gas mixtures.

Due to the formation of the water film, the materials is particularly suited for extinguishing fires of liquid materials, without containing any poly- or perfluorinated compounds.

According to a preferred embodiment of the invention, the surface-active agent contains one molecule selected from the group containing

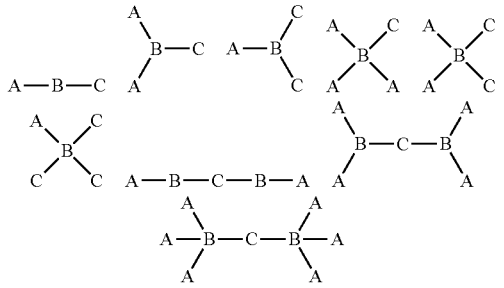

or mixtures thereof, wherein A denotes a substituted or unsubstituted carbohydrate or carbohydrate derivative with one to four sugar units;

B denotes an optional linker substructure of at least one atom or a chain; and

C denotes an oligosiloxane, preferably a di-, tri- or tetrasiloxane.

The subcomponents of the surface-active agent will be described in further detail below, wherein it is possible to combine the individual characteristics or informational details in any desired manner.

Subcomponent A:

A is a substituted or unsubstituted carbohydrate or carbohydrate derivative with one to four sugar units. Preferably, these are mono-, di- and trisaccharides; i.e., molecules having one, two or three sugar units.

Moreover, subcomponent A or parts of subcomponent A can also be made up of carbohydrate derivatives, such as, for example, saccharic acids (aldonic acids, uronic acids or aldaric acids), sugar alcohols (alditols), amino sugars or cyclitols, as well as the ethers, esters, amides or thioesters thereof.

The terms "sugar units" or "carbohydrate" are understood to mean, in particular, hexoses, pentoses or cyclitols (when di- or higher-valent saccharides are present) that preferably form glycosidic bonds with each other.

As described, the carbohydrates can be substituted or unsubstituted, wherein unsubstituted carbohydrates are preferred, due to resulting better water solubility.

If the carbohydrates are substituted, ethyleneoxy, oligo (ethyleneoxy), methyl, ethyl, allyl or acetyl substituents are preferred.

Preferred carbohydrates or carbohydrate derivatives within the meaning of the present invention are for monosaccharides: glucose, glucosamine, fructose, galactose;

for disaccharides: maltose, isomaltose, saccharose, cellobiose, lactose, trehalose;

for trisaccharides: raffinose, maltotriose, isomaltotriose, maltotriulose, ciceritol;

for cyclitols: inosite, quebrachitol, pinitol;

for saccharic acids: gluconic acid, glucuronic acid, glucaric acid, tartaric acid, galactonic acid, galacturonic acid, galactaric acid, mannonic acid, mannuronic acid, mannaric acid, fructonic acid, fructuronic acid, fructaric acid, arabinonic acid, arabinuronic acid. arabinaric acid, xylonic acid, xyluronic acid, xylaric acid, ribonic acid, riburonic acid, ribaric acid, ascorbic acid:

for alditols: sorbitol, xylitol, mannitol, lactitol, maltitol, isomaltitol, threitol, erythritol.

Subcomponent B:

B is an optional linker substructure made up of at least one atom or chain, preferably carbon and/or nitrogen and/or oxygen atoms (wherein O—O-bonds should be excluded).

This chain can be a pure alkyl chain, meaning, for example an unsubstituted or, if necessary, alkyl-substituted alkylene moiety.

Alternately, B can also contain ether, ester or amide groups. For example, B can contain glycerin, poly- and/or oligoethylene glycol, poly- and/or oligopropylene glycol, pentaetythrite, alkylamines or carboxylic acids as substructure.

Via an anomeric carbon atom, B preferably forms a glycosidic bond with moiety A. If A is a carboxylic acid derivative, B can also be linked to A via an amide or ester bond.

B is preferably linked to moiety C (siloxane) via a Si—C— or Si—O-bond.

It should be noted that, in some surface-active agents according to the present invention, subcomponent B can also be omitted; meaning, A and C can be linked directly, if necessary.

Moreover, in some surface-active agents according to the present invention, moiety B-C and/or C can also be coupled to the carbohydrate or carbohydrate derivative A in other regiochemical positions.

Subcomponent C:

C is an oligosiloxane, preferably a di-, tri- or tetrasiloxane. Methyl- and ethylsiloxanes or siloxanes mixed with methyl and ethyl moieties are preferred.

If C is a tri- or higher-valent siloxane, C can be linked to B (or, if necessary, A) via one of the terminal siloxanes (and whereby a kind of "continuous chain" is formed); alternately, C can also be linked to B (or, if necessary, A) via one of a centrally located siloxanes, such that a kind of X- and/or T-like or branched structure is formed. If C is derived from at di- or trihydrosiloxane, the substructures A-B and/or A that are bonded to C can be the same or different.

Preferably, C has one of the following structures:

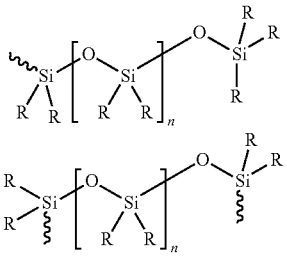

-continued

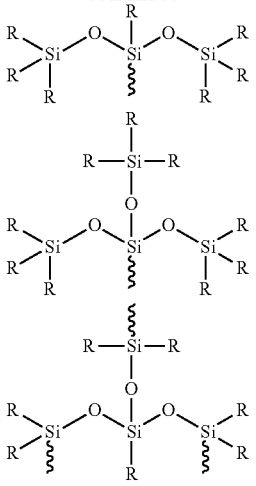

wherein each R denotes independently of the others ethyl or methyl, and n is between 0 and 10, preferably between 0 and 5, more preferred it is 0, 1 or 2.

According to a preferred embodiment of the present invention, the foam-extinguishing concentrate additionally comprises one or more of the following components: foaming agents, film stabilizers, antifreeze, preservatives and anticorrosives, solutizers, as well as buffers.

The components will be discussed in further detail below, wherein individual characteristics or details can be combined as desired.

Foaming Agents:

Co-tensides can be added to improve the foaming properties. In particular, these can be: linear alkyl benzene sulfonates, secondary alcane sulfonates, sodium alkyl sulfonates, α-olefin sulfonates, sulfosuccinic acid esters, α-methyl ester sulfonates, alcohol ethoxylates, alkyl phenol ethoxylates, fatty alcohol ethylene oxide/propylene oxide adducts, glycoside surface-active agents (for example, Glucopon, which is particularly preferred), lauryl sulfates, laureth sulfates, imidazolium salts, laurimino dipropionate, acryl copolymers. Conceivable counter ions for the surface-active agents contained in this list are primarily $Li^+$, $Na^+$, $K^+$, $NH_4^+$, $N(C_2H_5)_4^+$.

Film-Forming Agents, Film Stabilizers:

To improve film- and foam-specific properties, it is possible to add, inter alia, the following components to the foaming agent concentrate: polysaccharides, alginates, xanthan rubber, and starch derivatives.

Antifreeze:

To improve the resistance to freezing temperatures and capacity for use at low temperatures, it is possible to add the following components, inter alia, to the foaming agent concentrate: ethylene glycol, propylene glycol, glycerin, 1-propanol, 2-propanol, urea, and mineral salts.

Preservatives and Anticorrosives

To improve shelf life and to protect the storage containers and devices, it is possible to add the following components, inter alia, to the foaming agent concentrate: formaldehyde solution, alkyl carboxylic acid salts, ascorbic acid, salicylic acid, and tolyltriazoles.

Solutizers:

To improve solubility of the components, it is possible to add the following components, inter alia, to the foaming agent concentrate: butyl glycol, butyl diglycol, and hexylene glycol.

Buffers:

In terms of their shelf-life, siloxane tensides are pH-sensitive. Buffering the concentrate to a pH ca. 7 is therefore advantageous. Buffer systems can be, for example: potassium dihydrogen orthophosphate/sodium hydroxide, tris(hydroxymethyl)aminomethane/hydrochloric acid, disodium hydrogen phosphate/hydrochloric acid citric acid/sodium hydroxide, citric acid/sodium acetate.

The present invention relates also to the use of a tenside or surface-active agent containing at least one substituted or unsubstituted carbohydrate or carbohydrate derivative, as well as at least one oligosiloxane as additive to the fire-extinguishing foams and/or fire-extinguishing foam concentrates.

The previously mentioned, as well as claimed, components that are also described in the embodiments, and which must be used according to the invention, are not subject to any special exclusions in terms of size, shape, design, material selection and technical conception, which is why the selection criteria that are known in the field of use are applicable without restriction.

Further details, characteristics and advantages of the subject-matter of the present invention can be derived from the dependent claims as well as from the description of the associated examples below, and which are understood purely as being of an illustrating nature and in no way limiting with regard to the scope of protection.

EXAMPLE I

Example I relates to a surface-active agent according to the present invention having the following structure:

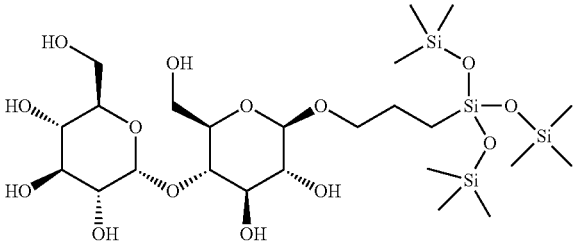

The spreading behavior of a solution of 2 g/Lg/L in Example I was studied; it was found that this compound spreads.

A solution of 2 g/L Example I and 0.5 g/L SDS behaved in the same manner.

EXAMPLE II

Example II relates to a surface-active agent according to the present invention having the following structure:

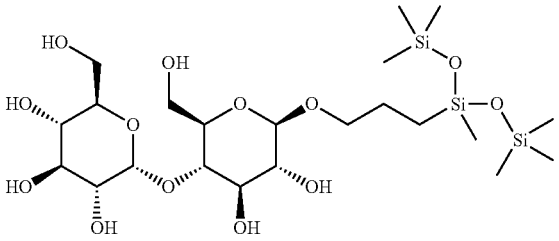

The spreading behavior of a solution of 2 g/L Example II and 0.24 g/L SDS was studied; it was found that this compound spreads very quickly. A similar behavior (although with slower spreading action) was established for a solution of 2 g/L Example II and 0.25 g/L Hansanol NS 242 cone, (sodium laureth sulfate 2EO).

A solution of 500 mg/L Example II and 6 g/L Glucopon 215 CS UP (alkyl polyglycoside with C8-C10 alkyl chain length) was studied as well; it was found that the substance spreads.

EXAMPLE III

Example III relates to a surface-active agent according to the present invention having the following structure:

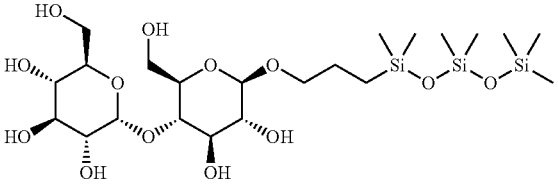

The spreading behavior of a solution of 2 g/L Example III and 0.5 g/L SDS was studied; it was found that this compound spreads very quickly.

EXAMPLE IV

Example IV relates to a surface-active agent according to the present invention having the following structure:

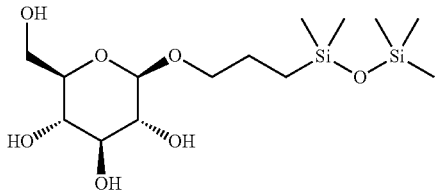

The spreading behavior of a solution of 2 g/L Example IV was studied; it was found that this compound spreads very quickly.

A solution of 2 g/L Example IV and 0.5 g/L SDS showed the same behavior.

EXAMPLE V

Example V relates to a surface-active agent according to the present invention having the following structure:

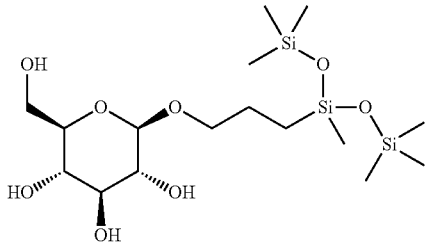

The spreading behavior of a solution of 2 g/L Example V and 0.5 g/L SDS was studied; it was found that this compound spreads very quickly.

EXAMPLE VI

Example VI relates to a surface-active agent according to the present invention having the following structure:

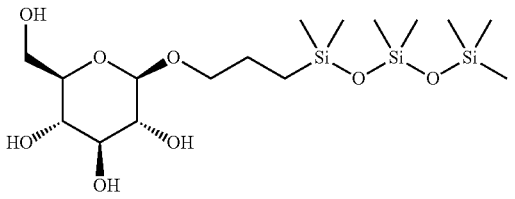

The spreading behavior of a solution of 2 g/L Example VI and 0.5 g/L SDS was studied; it was found that this compound spreads very quickly.

EXAMPLE VII

Example VII relates to a surface-active agent according to the present invention having the following structure:

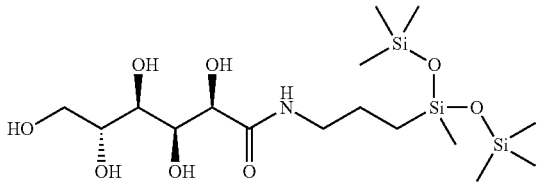

The spreading behavior of a solution of ca. 250 mg/L Example VII was studied; it was found that this compound spreads very quickly. It applies similarly for a solution of 500 mg/L Example VII and 6 g/L Glucopon 215 CS UP (alkyl polyglycoside with C8-C10 alkyl chain length).

EXAMPLE VIII

Example VIII relates to a surface-active agent according to the present invention having the following structure:

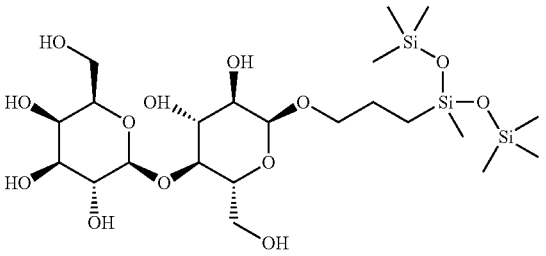

The spreading behavior of a solution of 2 g/L Example VIII and 0.5 g/L SDS was studied; it was found that this compound spreads.

A solution of 2 g/L Example VIII and 6 g/L Glucopon 215 CS UP (alkyl polyglycoside with C8-C10 alkyl chain length) showed the same behavior.

EXAMPLE IX

Example IX relates to a surface-active agent according to the present invention having the following structure:

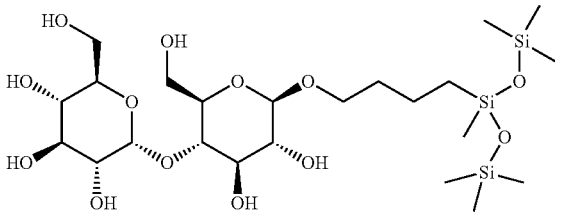

The spreading behavior of a solution of 2 g/L Example IX and 0.5 g/L SDS was studied; it was found that this compound spreads.

A solution of 2 g/L Example IX and 6 g/L Glucopon 215 CS UP (alkyl polyglycoside with C8-C10 alkyl chain length) showed the same behavior.

EXAMPLE X

Example X relates to a surface-active agent according to the present invention having the following structure:

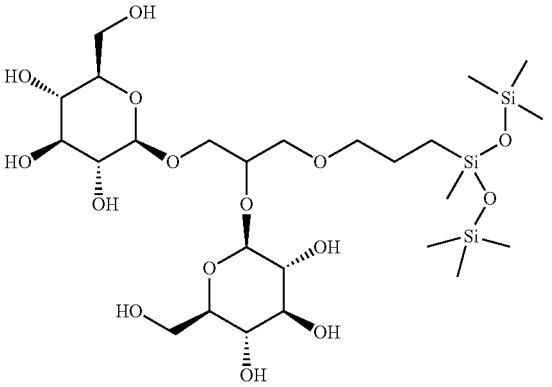

The spreading behavior of a solution of 2 g/L Example X was studied; it was found that this compound spreads. The same applies for a solution of 2 g/L Example X and 0.5 g/L SDS.

A solution of 2 g/L Example X and 6 Glucopon 215 CS UP (alkyl polyglycoside with C8-C10 alkyl chain length) showed the same behavior.

EXAMPLE XI

Example XI relates to a surface-active agent according to the present invention having the following structure:

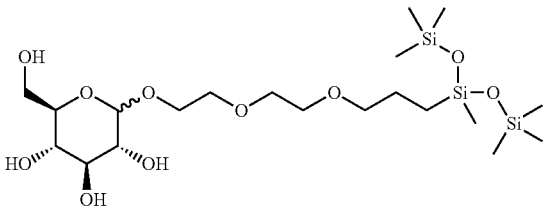

The spreading behavior of a solution of 2 g/L Example XI and 0.5 g/L SDS was studied; it was found that this compound spreads.

A solution of 2 g/L Example XI and 6 g/L Glucopon 215 CS UP (alkyl polyglycoside with C8-C10 alkyl chain length) showed the same behavior.

COMPARISON EXAMPLES

Selected as comparison examples were surface-active agents containing polyethylene glycol units instead of carbohydrate moieties.

Comparison Example I

A surface-active agent containing polyethylene glycol units was selected as a surface-active agent 1 for comparison. It has the following structure:

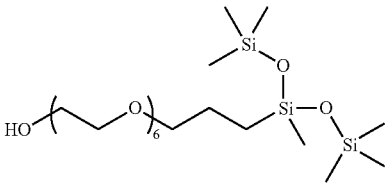

A solution of 2 g/L Comparison Example I and 0.5 g/L SDS was studied. The solution collected on the base of the bowl; no spreading was observed. A solution of comparison example I without SDS showed the same behavior.

Comparison Example II

A compound with the following structure was selected for Comparison Example II:

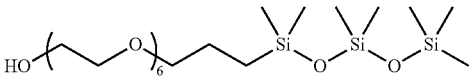

A solution of 2 g/L. Comparison Example II and 0.5 g/L SDS was studied. The solution collected on the base of the bowl; no spreading was observed. A solution of comparison example II without SDS showed the same behavior.

Comparison Example III

A compound having the following structure was selected for comparison example III:

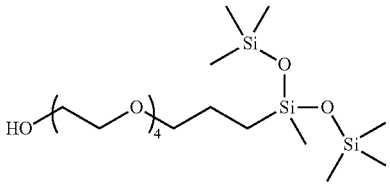

A solution of 2 g/L Comparison Example Ill and 0.5 g/L SDS was studied. The solution collected on the base of the bowl; no spreading was observed. A solution of comparison example III without SDS showed the same behavior.

Comparison Example IV

A compound having the following structure was selected for comparison example IV:

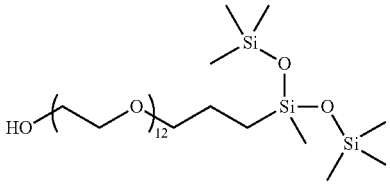

A solution of 2 g/L Comparison Example IV and 0.5 g/L SDS was studied. The solution collected on the base of the bowl; no spreading was observed. A solution of comparison example IV without SDS showed the same behavior.

Preparation of Glycoside Siloxane

The siloxane glycoside surface-active agents as shown in the examples can be prepared from carbohydrates, inter alia, as follows:

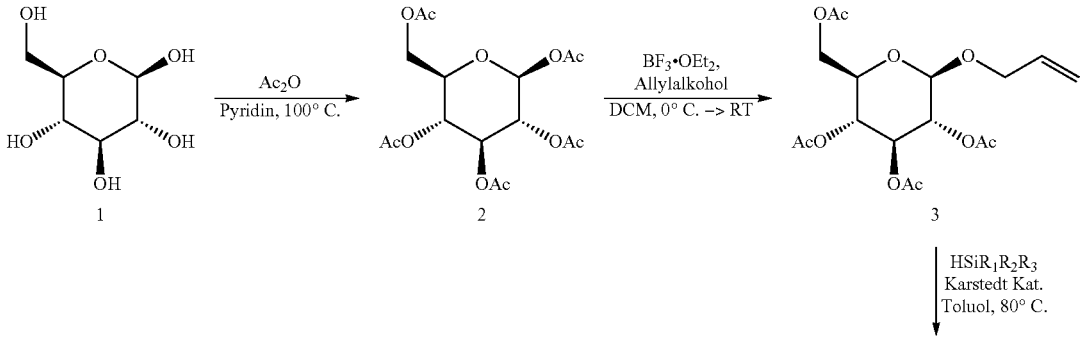

-continued

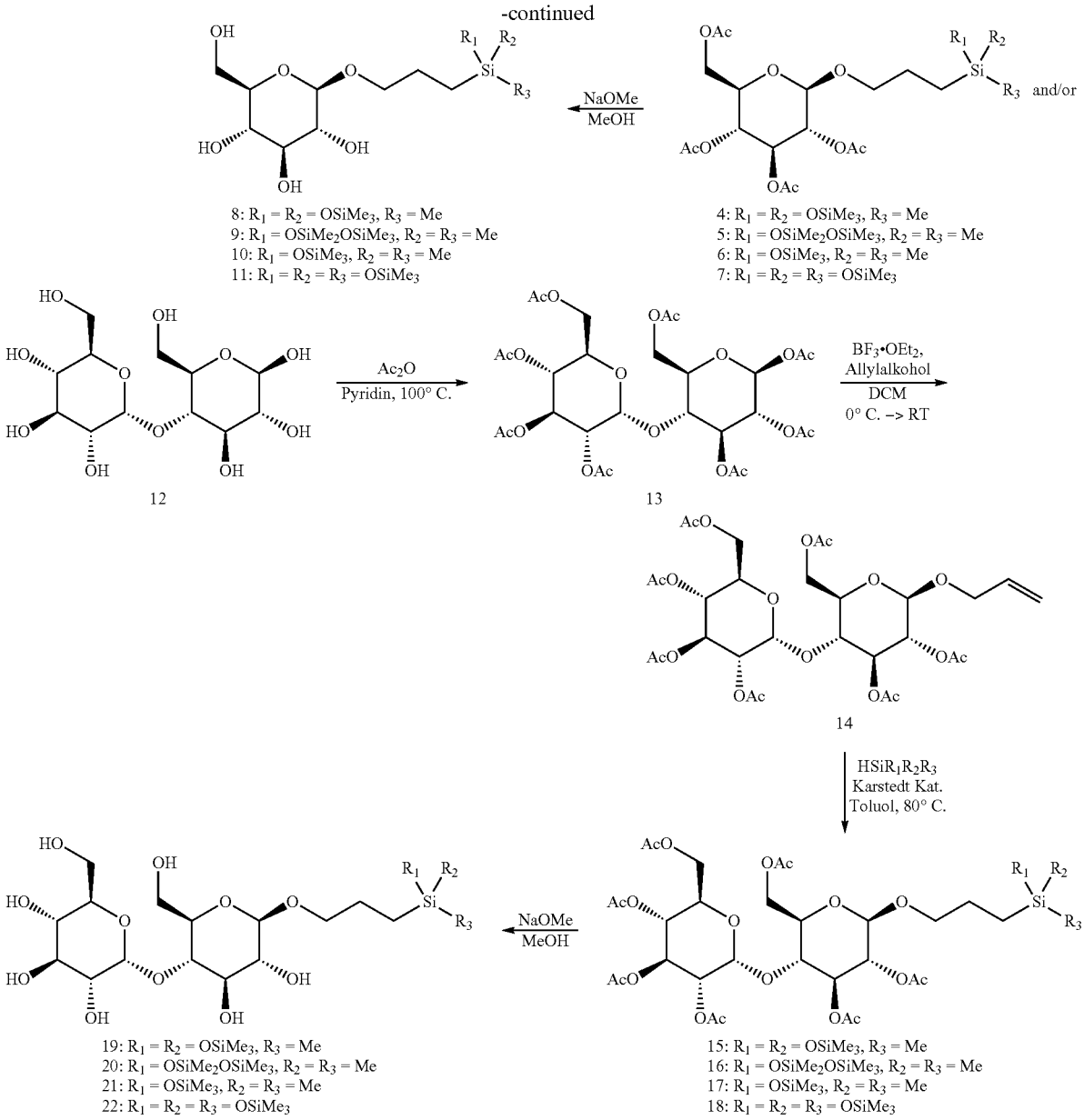

| German | English |
|---|---|
| Pyridin | Pyridine |
| Allylalkohol | Ally alcohol |
| Karstedt Kat. Toluol | Karstedt-catalogue toluene |

Examination of the Spreading Behavior 5 ml cyclohexane was added to a petri dish of 9 cm diameter for the study of the spreading behavior. One drop, respectively, was then added to the un-foamed tenside solution; it was monitored to see if and how the surface-active agent solution spread out over the surface of the cyclohexane.

Individual component combinations and set forth characteristics of previously mentioned embodiments are of an exemplary nature; replacing and substituting these teachings with other teachings as set forth in this specification and in the cited specifications is also expressly considered. The person skilled in the art will recognize that variations, modifications and other embodiments than those that have presently been described are likewise possible without deviating from the inventive idea and scope of protection. Correspondingly, the aforementioned description is of an exemplary nature and must not be understood as limiting to the scope of the invention. The term "comprising," as used in the claims, does not exclude the use of other components or steps. The indefinite article "a/an" does not preclude a plural meaning. The mere fact that certain measurements are recited in mutually varying claims does not mean that as combination of these measures cannot be advantageously implemented. The scope of the present invention is defined in the following claims and any related equivalents thereto.

The invention claimed is:

1. A material capable of forming a fire extinguishing film forming solution when added with a component consisting of water, the material comprising a surface-active agent containing at least one substituted or unsubstituted carbohydrate or carbohydrate derivative and at least one oligosiloxane, wherein the surface-active agent comprises a molecule that is selected from the group containing

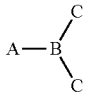

or mixtures thereof, wherein A is a substituted or unsubstituted carbohydrate or carbohydrate derivative with one to four saccharic units, B is a linker substructure of at least one atom or chain, and C is an oligosiloxane, wherein the oligosiloxane is a methyl or ethyl or mixed methyl and ethyl siloxane.

2. A method of manufacturing a material capable of forming a fire extinguishing film forming solution when added with a component consisting of water, the method comprising the steps of:

adding to a fire-extinguishing foam or a fire-extinguishing foam concentrate a surface-active agent containing at least one substituted or unsubstituted carbohydrate or carbohydrate derivative and at least one oligosiloxan, wherein the surface-active ager es a molecule that selected from the group containing

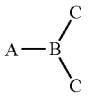

or mixtures thereof, wherein A is a substituted or unsubstituted carbohydrate or carbohydrate derivative with one to four saccharic units, B is a linker substructure of at least one atom or chain, and C is an oligosiloxane, wherein the oligosiloxane is a methyl or ethyl or mixed methyl and ethyl siloxane.

* * * * *